United States Patent [19]

Fichter

[11] 4,217,121

[45] Aug. 12, 1980

[54] FILTER MODULE WITH INDEPENDENT SECURING MEANS FOR AN OUTLET GRILLE, AND FOR A FILTER ELEMENT BEHIND THE GRILLE

[76] Inventor: Frederick L. Fichter, 3283 Dawes Ave., SE., Grand Rapids, Mich. 49508

[21] Appl. No.: 906,270

[22] Filed: May 15, 1978

[51] Int. Cl.[2] ..... B01D 35/02; B01D 46/00

[52] U.S. Cl. ..... 55/478; 55/385 A; 55/493; 55/501; 55/502; 55/504; 55/506; 55/511; 98/40 D

[58] Field of Search ..... 55/385 A, 478, 480, 55/483, 484, 493, 494, 501, 502, 504, 511, 506; 98/36, 40 D

[56] References Cited

U.S. PATENT DOCUMENTS

| | | | |
|---|---|---|---|
| 1,788,171 | 1/1931 | Preble | 55/483 |
| 2,335,315 | 11/1943 | Seymour | 55/480 X |
| 2,580,648 | 1/1952 | Blair et al. | 55/493 X |
| 3,001,464 | 9/1961 | Moore | 98/40 D |
| 3,229,609 | 1/1966 | Larson et al. | 98/36 |
| 3,280,541 | 10/1966 | Soltis | 55/483 |
| 3,323,437 | 6/1967 | Knab | 98/40 D |
| 3,357,763 | 12/1967 | Toper | 55/478 UX |
| 3,511,010 | 5/1970 | Wood | 55/484 UX |
| 3,570,220 | 3/1971 | Felter | 55/493 X |
| 3,714,765 | 2/1973 | Simonelli | 55/478 X |
| 3,986,850 | 10/1976 | Wilcox | 55/484 X |
| 4,034,659 | 7/1977 | Raider | 98/40 D |

FOREIGN PATENT DOCUMENTS

| | | | |
|---|---|---|---|
| 2293126 | 6/1976 | France | 55/385 A |

*Primary Examiner*—Kathleen J. Prunner
*Attorney, Agent, or Firm*—Glenn B. Morse

[57] ABSTRACT

A filter module has a housing providing a receptacle for a standard filter element, and also has a lateral extension for accommodating securing means to hold the filter element in place. The lateral extension defines a grille opening for removeably receiving an outlet grille in flush relationship, the grille opening extending laterally beyond the receptacle. A seal gasket closes the space between the grille and the filter element, embracing the securing means.

1 Claim, 5 Drawing Figures

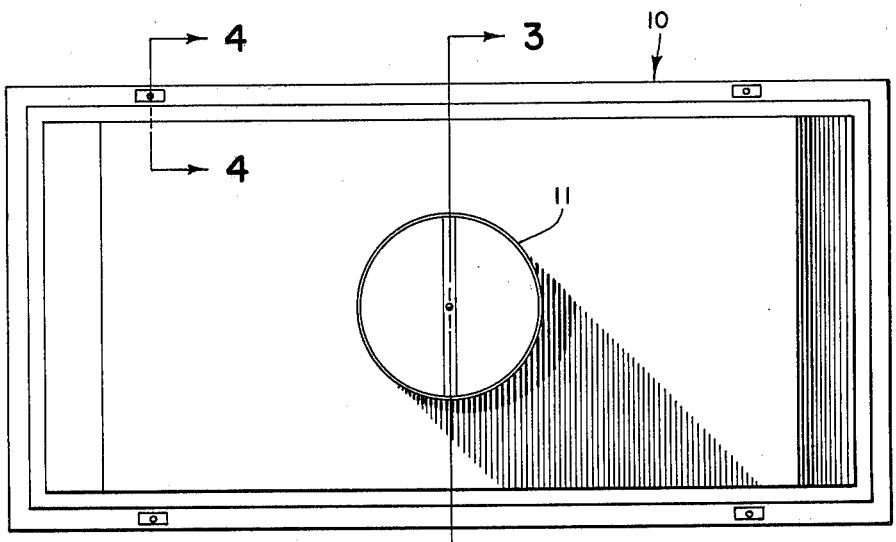
FIG. 2
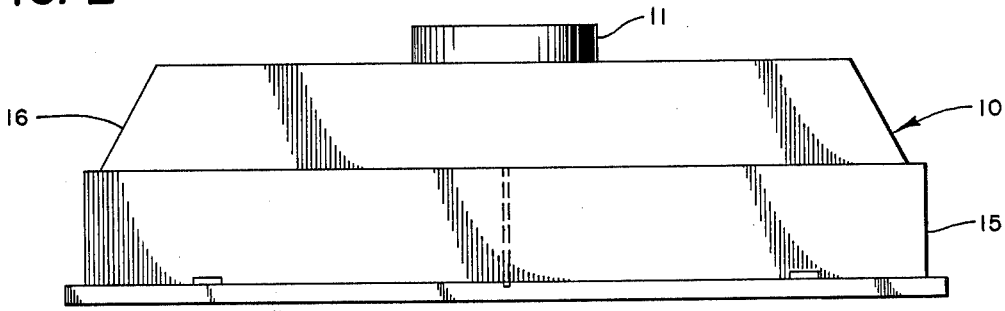
FIG. 1
FIG. 3
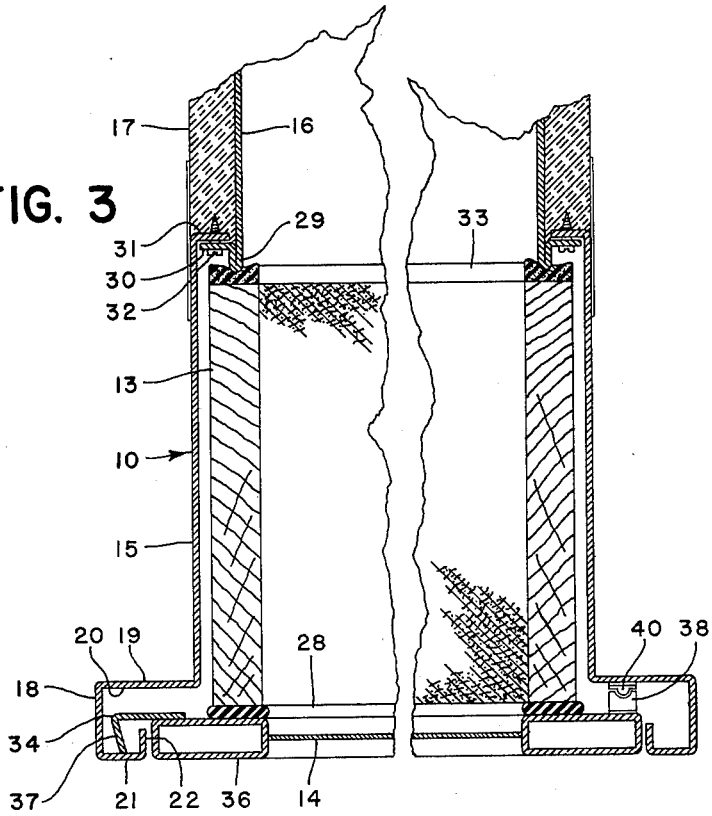
FIG. 4
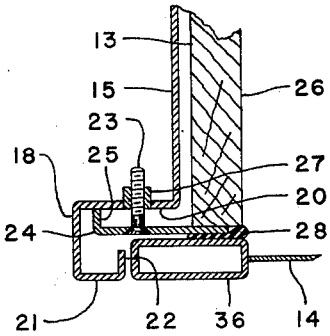

FILTER MODULE WITH INDEPENDENT SECURING MEANS FOR AN OUTLET GRILLE, AND FOR A FILTER ELEMENT BEHIND THE GRILLE

BACKGROUND OF THE INVENTION

"Clean rooms" are required in hospitals, laboratories, and industrial operations wherever it is necessary to maintain a work environment substantially free of particles suspended in the air. The most common form of these installations involves a group of filter modules defining a major portion of the ceiling area of a room, which provide an inflow of filtered air proceeding to a convenient outlet, usually near the floor. Each of the modules is essentially a housing accommodating a conventional filter element having a rectangular box-like configuration. These are standard, and must necessarily be replaced frequently. Since "clean" atmospheric conditions are defined in terms of suspended particles having dimensions on the order of a few microns, it is of crucial importance that the modular units provide an absolute minimum of passages or recesses through or in which such particles can move or accumulate. The outlet opening from which air emerges after moving through the filter element is normally covered by a protective grille, which becomes an inviting location for particles to accumulate during periods in which the air may be stagnant within the room. When the air flow through the filter modules is turned on, such accumulations are obviously subject to disturbance and discharge back into the room. Recesses at fastenings that are exposed to the room also present problems. Replacement of the filter element involves withdrawing it through the opening normally occupied by the grille, and replacing it in the reverse of this procedure. Such action also obviously tends to disturb any accumulations of particles that may have found a way into recesses of any description in the adjacent area.

The importance of "clean room" installations has generated enough attention to produce quite a number of structural arrangements in the filter modules. These have displayed a considerable difference one from another in their functioning characteristics with regard to cost and the relative tendency to entrap and redistribute particles in the room space during service and maintenance operations, and at times when the air flow system is turned on after periods of stagnation.

The present application presents an improvement on the U.S. Pat. No. 4,088,463 of Irwin M. Smith, issued on May 9, 1978. That application is now owned by the present applicant. Problems encountered during the removal and replacement of the filter modules, and in cleaning the grilles in the structure disclosed in the Smith application, have resulted in the present development.

SUMMARY OF THE INVENTION

The housing of a filter module has a receptacle defining a space very slightly greater than that required by a standard replaceable filter element, and has a lateral extension adjacent the outlet opening of the module providing space for securing means for holding the filter element in position. The lateral extension also defines an opening for the grille, which is somewhat larger than the adjacent dimensions of the receptacle, so that the grille opening renders the filter element securing means accessible easily to a workman standing in the room served by the assembly of modules. The grille is then received in flush relationship in its housing opening, and is hinged to it on one side within the confines of the lateral extension of the housing. Preferably on the opposite side of the unit, a disengagable fastening (preferably a spring latch) interengages with the grille, thus completely concealing all fastenings and moveable components from exposure to the general stream of filtered air. The grille is also sealed directly to the filter element, which causes all of the filtered air discharged to move through the grille, rather than around it and into the spaces occupied by the hinge and the spring latch. The hinge is disengagable, permitting the grille to be removed bodily, cleaned, and reinstalled without disturbance to the filter element or its securing means.

DESCRIPTION OF THE DRAWINGS

FIG. 1 is a side elevation of a filter module, which is essentially that of the outer housing.

FIG. 2 is a top view with respect to FIG. 1.

FIG. 3 is a sectional elevation on an enlarged scale on the plane 3—3 of FIG. 2.

FIG. 4 is a sectional elevation on an enlarged scale on the plane 4—4 of FIG. 2.

DESCRIPTION OF THE PREFERRED EMBODIMENT

Figure 5:
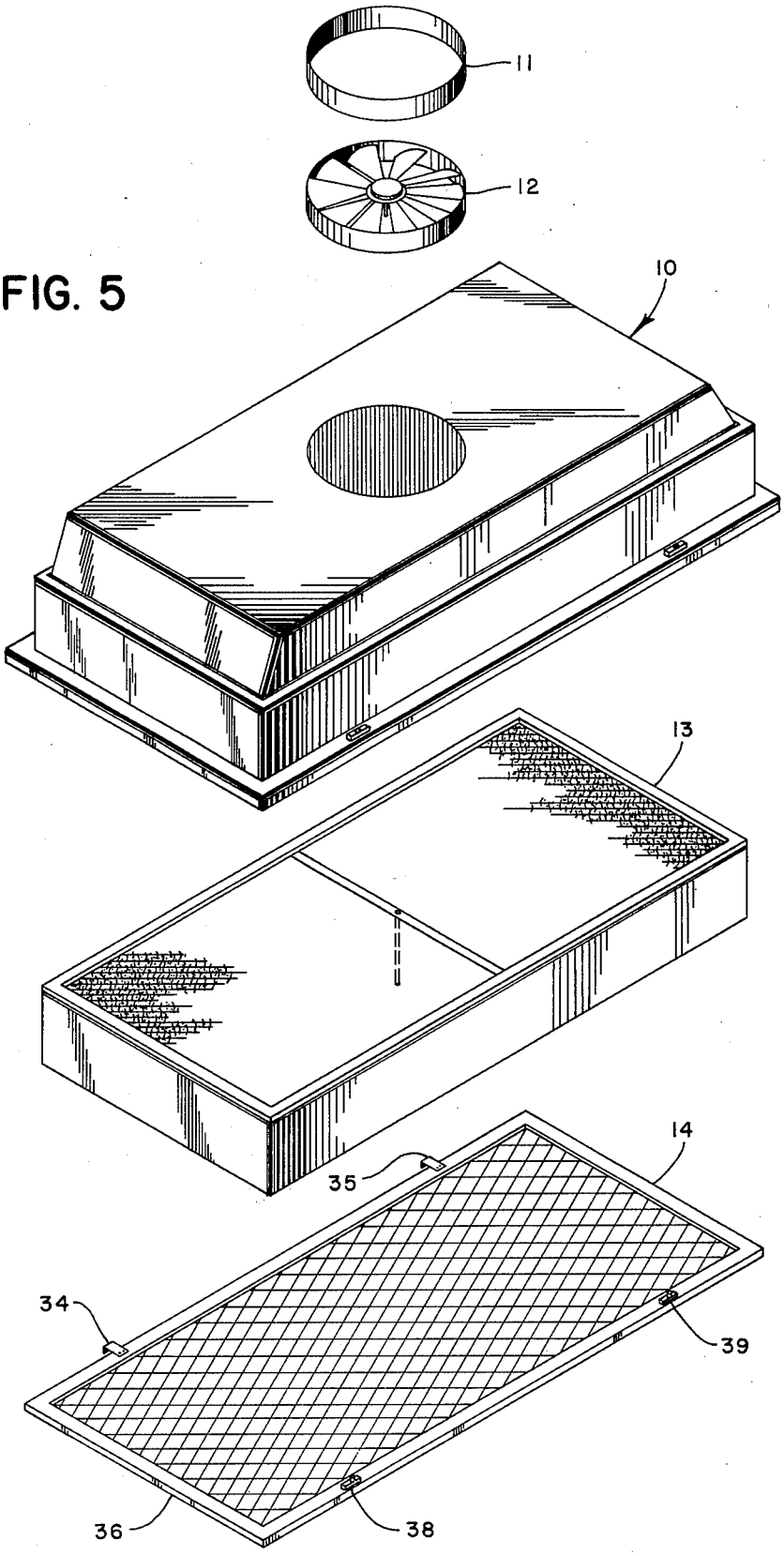
FIG. 5 is an exploded view showing the components of the module assembly.

Referring particularly to FIGS. 1, 2, and 5, the illustrated module includes the housing generally indicated at 10, the duct collar 11 containing the variable damper 12, the standard filter element 13, and the grille 14. The damper control unit 12 is absent from FIG. 2. The housing 10 defines a receptacle 15 having a rectangular configuration slightly larger than the dimensions of the filter element 13. The upper portion 16 of the housing defines a space between the filter element and the duct connection provided by the collar 11 within which the air flow is equalized across the top of the filter element 13 so that the full area of the filter element can be utilized. It is often desirable to provide insulation material as shown at 17 in FIG. 3 around the portion 16 of the housing.

Referring now particularly to FIGS. 3 and 4, the housing 10 has a lateral extension indicated at 18 extending on at least the two opposite sides of the housing, and preferably around the periphery. The offset 19 of the lateral extension 18 provides the inner recess surface 20, which defines a space in conjunction with the inside surface of the shelf 21. This shelf terminates in a flange 22 extending toward the surface 20. The flange 22 defines the opening receiving the grille 14, which extends laterally beyond the receptacle 15 to expose a substantial portion of the recess surface 20 to access from below. This is utilized for the installation and removal of the screws 23 holding the retaining clips 24 in place, which have a fulcrum offset 25 bearing against the recess surface 20. The clips overlay part of the width of the frame member 26 of the filter element 13. Some sort of fixed nut of conventional design, as shown at 27, is preferably installed in the sheet metal forming the offset 19 to provide adequate threaded engagement with the screws 23. A gasket, preferably of resilient sponge-like material, is shown at 28, and the limitation of the length of the clip 24 to less than the full width of the filter frame member 26 permits the resilience of the gasket material 28 to embrace the clip to the point where air flow around it is blocked.

At the junction of the portions 15 and 16 of the housing, a bearing edge is provided by the fold 29 in the sheet metal forming the upper part 16 of the housing. The flange 30 is bent outward from this material, and is secured to the overlapping flange 31 of the housing portion 15 by sheet metal screws as shown at 32. The resilient sponge-like gasket 33 is conventional, and normally is provided with the filter element 13. Tightening of the screws 23 serves to press the filter element 13 against the edge 29 to provide an effective seal causing all of the air moving within the portion 16 of the housing to pass through the filter element 13, rather than around it. The construction of the junction between the portions 15 and 16 of the housing constitutes an extremely effective and economical use of material, and results in a very simple assembly technique.

When the filter element 13 has been installed in the receptacle 15, and held in place by the subsequent installation of the clips 24 and the screws 23, the grille 14 may be closed to the position shown in FIG. 3. Preferably at least two offset arms as shown at 34 and 35 are bonded to the peripheral frame 36 of the grille 14, and extend over the flange 22 of the shelf 21. The offset ends 37 of these clips bear on the inside surface of the shelf 21. The offset ends, in conjunction with the flange 22, form a hinge connection permitting the grille unit to be swung downward in a clockwise direction, as viewed in FIG. 3. A conventional spring latch has components 38-39 mounted on the frame of the grille, and mating components as shown at 40 mounted in opposite positions on the portion 19 of the housing. These latches may be of any convenient design, and provide for retention of the right side of the grille, as shown in FIG. 3. A light pulling action on the grille, delivered either manually, or with instruments interengaging the grille openings, will suffice to pull the right side of the grille downward by disengaging the resilient securing effect of the latch assemblies. The configuration of the clip ends 37 and the flange 22 at the opposite edge also provides for complete removal of the grille so that it can be washed separately without disturbing the filter element 13. The space defined between the portions 19 and 21 of the housing can also be cleaned without removal of the filter element. It is important that the grille is held in position by a system that does not present any exterior fastenings that have to be manipulated during the grille-removal process, and which would be exposed to the main flow of air through the filter element and into the room. The gap between the grille and the shelf 22, particularly in view of its placement outside the air flow path, has a minimal tendency to accumulate particles. Under severe design requirements, further gasketing could be easily incorporated between the edge of the grille frame 36 and the adjacent flanges 22, although this is normally not necessary.

I claim:

1. A housing for a clean room air filter of the type having a rigid peripheral frame carrying a sealing gasket at its upper end, said housing comprising:

an upper housing portion having upper and lower ends, said upper end being adapted for connection to an air supply duct;

a lower housing portion having upper and lower ends, said upper end of said lower housing portion being connected to said lower end of said upper housing portion, said lower housing portion being adapted to receive said filter;

a bearing edge projecting downwardly from said lower end of said upper housing portion and within the confines of said lower housing portion for sealingly engaging said gasket;

a lateral extension at said lower end of said lower housing portion extending outwardly around the entire periphery thereof;

a plurality of retaining clips each releaseably connected to said laterial extension and having an end portion adapted to engage the lower end of said peripheral frame of said filter, said clips extending across only a fraction of the width of said peripheral frame;

a grille having a peripheral frame;

means releaseably connecting said peripheral frame of said grille to said lateral extension; and a second sealing gasket positioned on the upper surface of said peripheral frame of said grille and adapted, when said filter is secured within said lower housing portion and said grille is connected to said lateral extension, to sealingly engage both said upper surface of said peripheral frame of said grille and the lower surface of said peripheral frame of said filter including the portions thereof immediately adjacent said retaining clips.

* * * * *